US009605554B2

(12) United States Patent
Hiller et al.

(10) Patent No.: US 9,605,554 B2
(45) Date of Patent: Mar. 28, 2017

(54) TURBOMACHINE

(71) Applicant: MTU Aero Engines AG, Munich (DE)

(72) Inventors: Sven-Juergen Hiller, Erdweg (DE); Erwin Bayer, Dachau (DE); Thomas Hess, Munich (DE); Peter Geiger, Munich (DE)

(73) Assignee: MTU AERO ENGINES AG, Munich (DE)

( * ) Notice: Subject to any disclaimer, the term of this patent is extended or adjusted under 35 U.S.C. 154(b) by 398 days.

(21) Appl. No.: 14/228,471

(22) Filed: Mar. 28, 2014

(65) Prior Publication Data

US 2014/0294570 A1 Oct. 2, 2014

(30) Foreign Application Priority Data

Mar. 28, 2013 (EP) ..... 13161673

(51) Int. Cl.

| | |
|---|---|
| ***F01D 11/08*** | (2006.01) |
| ***F01D 5/00*** | (2006.01) |
| ***F01D 5/20*** | (2006.01) |
| ***F01D 5/28*** | (2006.01) |
| ***F01D 11/12*** | (2006.01) |

(52) U.S. Cl.

CPC ..... *F01D 11/08* (2013.01); *F01D 5/005* (2013.01); *F01D 5/20* (2013.01); *F01D 5/284* (2013.01); *F01D 5/288* (2013.01); *F01D 11/122* (2013.01); *F05D 2300/611* (2013.01)

(58) Field of Classification Search

CPC ..... F01D 11/08; F01D 5/005; F01D 5/288; F01D 5/20; F01D 11/122; F01D 5/284; F05D 2300/611

USPC ..... 415/173.1, 173.5, 173.6, 174.5

See application file for complete search history.

(56) References Cited

U.S. PATENT DOCUMENTS

| | | | | |
|---|---|---|---|---|
| 4,299,865 | A * | 11/1981 | Clingman | F01D 11/122 427/243 |
| 4,884,820 | A | 12/1989 | Jackson et al. | |
| 7,178,808 | B2 | 2/2007 | Grunke et al. | |
| 7,842,335 | B2 | 11/2010 | Skoog et al. | |
| 2003/0138641 | A1* | 7/2003 | Fukudome | C04B 35/486 428/446 |
| 2004/0012152 | A1* | 1/2004 | Grunke | C23C 28/3215 277/415 |
| 2007/0134408 | A1 | 6/2007 | Skoog et al. | |
| 2009/0148694 | A1* | 6/2009 | Kaiser | F01D 5/288 428/332 |

(Continued)

FOREIGN PATENT DOCUMENTS

| | | | |
|---|---|---|---|
| DE | 10225532 | C1 | 12/2003 |
| DE | 102009012945 | A1 | 9/2010 |

(Continued)

*Primary Examiner* — Hoang Nguyen

(74) *Attorney, Agent, or Firm* — Abel Law Group, LLP

(57) ABSTRACT

Disclosed are a turbomachine having at least one radial gap seal which has at least two opposite ceramic coatings which are constructed in each case from a ceramic powder, the particle size of which is smaller than 1.0 μm, and a turbomachine having at least one radial gap seal, wherein the coatings are built up from powder-based individual layers, the outer layer of which has a higher ceramic fraction than a base layer close to the rotor or stator section respectively, wherein the particle size of the powder material is smaller than 1.0 μm.

20 Claims, 1 Drawing Sheet

(56) References Cited

U.S. PATENT DOCUMENTS

| | | | | |
|---|---|---|---|---|
| 2010/0021716 | A1 | 1/2010 | Strock et al. | |
| 2010/0119706 | A1* | 5/2010 | Werner | B22F 1/025 427/180 |
| 2011/0217484 | A1* | 9/2011 | Lubcke | B23P 6/007 427/569 |

FOREIGN PATENT DOCUMENTS

| | | | |
|---|---|---|---|
| DE | 102011081323 | B3 | 6/2012 |
| EP | 0292250 | A1 | 11/1988 |
| EP | 1739204 | A2 | 1/2007 |
| EP | 2009141 | A2 | 12/2008 |
| EP | 2540973 | A1 | 1/2013 |

* cited by examiner

TURBOMACHINE

BACKGROUND OF THE INVENTION

1. Field of the Invention

The present invention relates to a turbomachine with coatings on the rotor and stator sections thereof.

2. Discussion of Background Information

In turbomachines such as gas turbines and steam turbines, it is necessary for radial gaps between rotating and static machine parts to be sealed off in order to prevent secondary flow losses. This applies for example to the sealing of the radial gap between a guide blade tip and an opposite disk vane or between a rotor blade tip and an opposite stator section.

To seal off the radial gaps, use is conventionally made of labyrinth seals. It has however been found that the machine parts that form the labyrinth seals are subject to high levels of wear and intense heating in the event of rubbing. The rubbing and the heating can lead to cracks, which can have severe consequences in particular for the rotating parts. The rotating part is thus normally provided with so-called armoring. The armoring is in particular a hard layer applied by means of a thermal spraying process. By contrast, the static part remains uncoated and is thus soft in relation to the rotating component. As a result, the static component becomes correspondingly abraded and worn in the event of rubbing. The armorings are however normally rough, which leads to corresponding heating in the event of rubbing. Furthermore, it has been found that the armorings have a tendency to spall.

It is an object of the invention to create a turbomachine which permits durable sealing and/or a reduction of a radial gap between a rotor and a stator of the turbomachine.

SUMMARY OF THE INVENTION

The present invention provides a turbomachine having a rotor and a stator, wherein, in at least one radial gap between the rotor and the stator, there is arranged a seal for reducing the at least one radial gap. The seal has two opposite coatings, of which one coating is applied to a stator section that delimits the at least one radial gap radially to the outside and the other coating is applied to a rotor section that delimits the at least one radial gap radially to the inside. The coatings are built up from a ceramic powder, the particle size of which is smaller than 1.0 μm.

The present invention further provides a turbomachine having a rotor and having a stator, wherein, in at least one radial gap between the rotor and the stator, there is arranged a seal for reducing the at least one radial gap. The seal has two opposite coatings, of which one coating is applied to a stator section that delimits the at least one radial gap radially to the outside and the other coating is applied to a rotor section that delimits the at least one radial gap radially to the inside. The coatings are built up from powder-based individual layers, the outer layer of which has a higher ceramic fraction than a base layer close to the rotor or stator section respectively. The particle size of the powder material is smaller than 1.0 μm.

A turbomachine according to the invention has a rotor and a stator. In at least one radial gap between the rotor and the stator, there is arranged a seal for reducing the radial gap, which seal has, according to the invention, two opposite coatings, of which one coating is applied to a stator section that delimits the radial gap radially to the outside and the other coating is applied to a rotor section that delimits the radial gap radially to the inside, wherein the coatings are built up from a ceramic powder, the particle size of which is smaller than 1.0 μm.

The so-called nanoceramic coatings according to the invention have a low risk of spalling, as they can be connected highly effectively to the main body and thus to the rotor section and to the stator section. The ceramic powder is preferably arranged on the rotor section and on the stator section in each case by way of an organometallic compound and then subjected to pressure and temperature treatment. The coatings may for example be produced by sintering at just 800° C. Furthermore, the nanoceramic coatings are very thin, which further reduces the risk of spalling. It is preferable for an overall layer thickness to be at most 0.1 mm. The particle size is preferably at most 100 nm. Furthermore, the nanoceramic coatings have a very smooth surface, which leads to low coefficients of friction in the event of rubbing, as a result of which only slight heating of the coatings occurs. A respective surface quality of the nanoceramic coatings may be additionally improved by grinding for smoothing purposes.

To prevent damage to the rotor and/or stator sections in the event of intense rubbing of the coatings, the coatings may be formed with different hardnesses.

It is preferable for the rotor coating to be harder than the stator coating. Catastrophic failure of the rotor section can be prevented in this way.

Furthermore, to realize a certain degree of elasticity in the seal region in the event of intense rubbing, the coatings may have different thicknesses. It is preferable for the rotor coating to be thicker than the stator coating, which can likewise serve to prevent a catastrophic failure of the rotating component.

The coatings are preferably composed of a multiplicity of individual layers. In this case, the individual layers each have an individual layer thickness which, in sum total, does not exceed the overall layer thickness of 0.1 mm. By means of the individual layers, it is possible for the overall layer thickness to be varied in a convenient manner. Furthermore, even in the case of a large overall layer thickness, a high degree of stability of the coatings is achieved. The individual layers are preferably applied successively in powder form and subjected jointly to the pressure and temperature treatment. The individual layers are no longer identifiable after the pressure and temperature treatment, such that, if only ceramic powders are used, a unipartite solid ceramic is obtained after the pressure and temperature treatment.

An alternative turbomachine according to the invention has a rotor and a stator. In at least one radial gap between the rotor and the stator there is arranged a seal for reducing the radial gap, which seal, according to the invention, has two opposite coatings, of which one coating is applied to a stator section that delimits the radial gap radially to the outside and the other coating is applied to a rotor section that delimits the radial gap radially to the inside, wherein the coatings are built up from powder-based individual layers, the outer layer of which has a higher ceramic fraction than a base layer close to the rotor or stator section respectively, wherein the particle size of the powder material is smaller than 1.0 μm.

As a result of the graduated form of the coatings, it is possible for large step changes in material between the rotor and stator section and the coating to be avoided. The coating can thus, with regard to its thermal expansion or its modulus of elasticity, be adapted to the rotor and stator section in layered fashion. In particular, the outer individual layer has a ceramic fraction of 100%, and is thus composed exclusively of a nanoceramic powder. By contrast, the base layer has a very high metal fraction.

An intense sealing action can be achieved if, in both exemplary embodiments, the radial gap seal is realized in the form of a labyrinth seal, wherein at least the rotor section is formed with a multiplicity of elevations pointing in the direction of the stator section.

BRIEF DESCRIPTION OF THE DRAWINGS

A preferred exemplary embodiment of the invention will be explained in more detail below on the basis of greatly simplified schematic illustrations, in which.

DETAILED DESCRIPTION OF THE INVENTION

Figure 1:
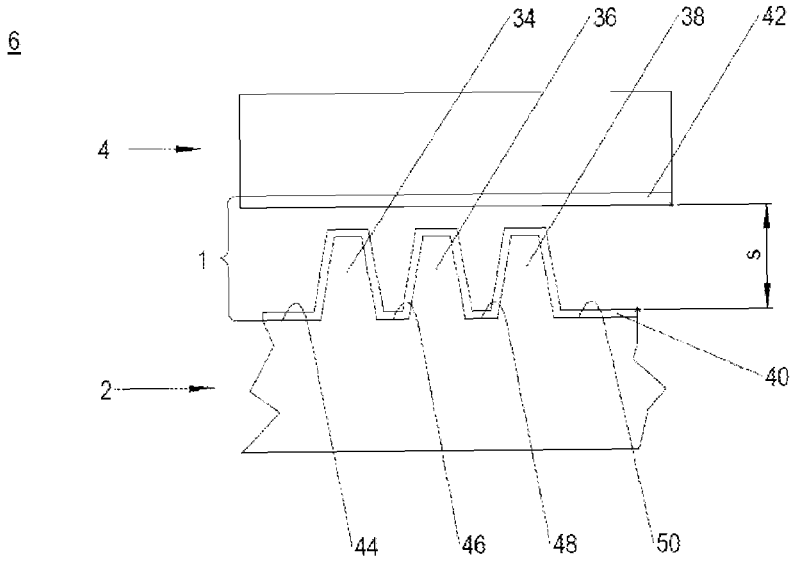
FIG. 1 shows a diagrammatic sketch of a seal of a turbomachine according to the invention.

FIG. 1 shows a seal 1 for reducing a radial gap s between a rotor section 2 and a stator section 4 of a turbomachine 6. The turbomachine 6 is preferably a gas turbine, and in particular an aircraft engine. The turbomachine 6 may however also be in the form of a steam turbine or the like.

Figure 2:
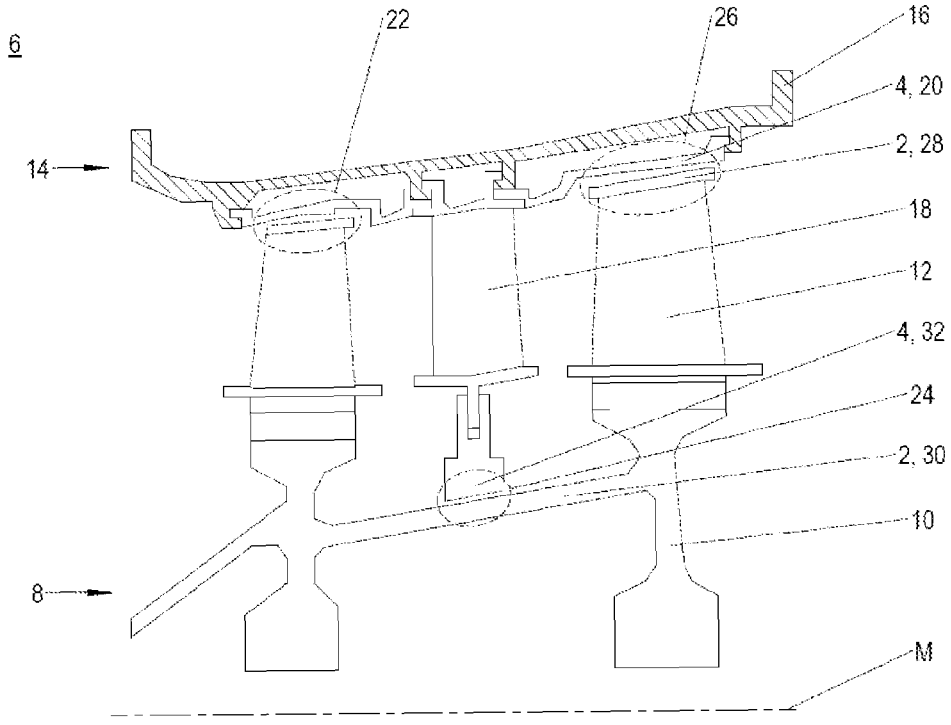
FIG. 2 shows a partial longitudinal section through a turbomachine according to the invention.

The rotor section 2 forms a part of a rotor 8, indicated in FIG. 2, of the turbomachine 6. The rotor 8 rotates about a machine axis M extending in the axial direction of the turbomachine 6, and has substantially a multiplicity of rotor disks 10 arranged in series in the flow direction of a hot gas, which rotor disks each bear a rotor blade row with a multiplicity of rotor blades 12 and are arranged on a common rotor hub (not shown).

The stator section 4 forms a part of a stator 14, indicated in FIG. 2, of the turbomachine 6. The stator 14 has substantially a housing 16 and a multiplicity of guide blade rows which are arranged so as to alternate with the rotor blade rows and which consist of individual guide blades 18 inserted into receptacles of the housing 16. Furthermore, the stator 14 has, between the guide blades 18 and thus opposite the rotor blades 12, in each case one outer sealing ring 20 inserted into the housing 16. The outer sealing ring 20 may be a unipartite and circumferentially closed outer sealing ring or may be composed of a multiplicity of sealing ring segments.

The seal 1 is for example provided, in the regions 22, 24, 26 depicted in FIG. 2, as a so-called intermediate stage seal in each case. In the front region 22 as viewed in the flow direction of the hot gas, the rotor section 2 is formed by the outer shrouds 28 of the rotor blades 12 of a front rotor blade row, and the opposite stator section 4 is formed by the opposite outer sealing ring 20. This construction is likewise used in the rear region 26. In the central region 24, the rotor section 2 forms a disk vane 30 which extends between the rotor disks 10, and the stator section 4 forms an inner sealing ring 32, which is arranged on an inner ring that connects the guide blades 18 to one another.

As denoted in FIG. 1, the seal 1 has a multiplicity of elevations 34, 36, 38 arranged one behind the other, a rotor-side coating 40, and a stator-side coating 42. In the exemplary embodiment depicted here, in which the seal 1 is arranged in the regions 22 and 26, the elevations 34, 36, 38 are arranged on the rotor side. The elevations 34, 36, 38 are then, for example, sealing tips of the outer shrouds 28. The elevations 34, 36, 38 may however basically also be arranged on the stator side. The respectively opposite rotor section 2 or stator section 4 is preferably of flat form, though may also be provided with corresponding projections which protrude radially between in each case two elevations 34, 36, 38.

The elevations 34, 36, 38 shown in FIG. 2 run in the circumferential direction and in the radial direction of the turbomachine 8 toward the stator section 4. As a result, the seal 1 is in the form of a labyrinth seal. The elevations 34, 36, 38 have a radial extent which is such that, when the turbomachine 6 is in the hot state, said elevations have a minimal spacing to the stator section 4 or, at the tips, slide lightly along the stator-side coating 42, such that the radial gap s is closed. In the exemplary embodiment shown, three elevations 34, 36, 38 are shown, though it is also possible for more or fewer elevations 34, 36, 38 to be provided. The elevations 34, 36, 38 and flat surfaces 44, 46, 48, 50, which run to the sides of the elevations 34, 36, 38, of the rotor section 2 are each provided with the rotor-side coating 40.

The coatings 40, 42 are so-called nanoceramic coatings, each with an overall layer thickness of preferably at most 0.1 mm. Said coatings are each built up from a ceramic powder, the particle size of which is smaller than 1.0 μm. The particle size of said powder is preferably 100 nm. The coatings 40, 42 are connected to the rotor section 4 and to the stator section 6 by pressure and temperature treatment, in particular a sintering process. In this way, a connection with high adhesive forces is formed between the rotor section 4 and the stator section 6, respectively, and the coatings 40, 42. The ceramic powder is preferably bound in an organometallic compound in order to be applied to the sections 4, 6.

The coatings 40, 42 are each composed of a multiplicity of individual layers, which together do not exceed the overall layer thickness. In the exemplary embodiment shown in FIG. 2, the individual layers are composed exclusively of the ceramic powder, such that the coatings 40, 42, after being produced, are solid ceramics.

It is alternatively possible for the individual layers to have different ceramic fractions, and thus for an outer individual layer to have a higher ceramic fraction than a base layer close to the rotor or stator section respectively. The outer individual layer preferably has a ceramic fraction of 100%, such that a low coefficient of friction is achieved. By contrast, the base layer has a very high metal fraction. A particle size of the ceramic powder and of the metal powder is however always less than 1.0 μm. Consequently, in this exemplary embodiment, the ceramic fraction increases proceeding from the rotor section 4 or the stator section 6 respectively in the direction of the outer individual layer, and the metal fraction correspondingly decreases. In this way, it is possible to avoid large step changes in material between the rotor section 4 or the stator section 6 respectively and the coatings 40, 42. It is alternatively also possible for individual ceramic layers and metal layers to be arranged in alternating fashion, with a ceramic layer forming the outer layer in each case.

To prevent destruction of the rotor section 4 as a result of intense rubbing of the elevations 34, 36, 38 against the stator section 4, the coatings 40, 42 are formed with different hardnesses. It is preferable for the rotor coating 40 to be harder than the stator coating 42. In this way, in the event of intense rubbing, the elevations 34, 36, 38 run into the stator coating 42, and do not break off.

Furthermore, to improve a failure characteristic of the seal 1, the coatings 40, 42 are of different thicknesses. In particular, the rotor-side coating 40 is thicker than the stator-side coating 42. It is self-evidently possible for the different coating hardnesses and the different coating thicknesses to be realized both as individual features and also in combination with one another.

Disclosed are a turbomachine having at least one radial gap seal which has at least two opposite ceramic coatings which are constructed in each case from a ceramic powder, the particle size of which is smaller than 1.0 μm, and a turbomachine having at least one radial gap seal, wherein the coatings are built up from powder-based individual layers, the outer layer of which has a higher ceramic fraction than a base layer close to the rotor or stator section respectively, wherein the particle size of the powder material is smaller than 1.0 μm.

LIST OF REFERENCE NUMERALS

1 Seal
2 Rotor section
4 Stator section
6 Turbomachine
8 Rotor
10 Rotor disk
12 Rotor blades
14 Stator
16 Housing
18 Guide blades
20 Outer sealing ring
22 Region
24 Region
26 Region
28 Outer shroud
30 Disk vane
32 Inner sealing ring
34 Elevation
36 Elevation
38 Elevation
40 Rotor-side coating
42 Stator-side coating
44 Flat surface
46 Flat surface
48 Flat surface
50 Flat surface
M Machine axis
s Radial gap

What is claimed is:

1. A turbomachine, wherein the turbomachine comprises a rotor and a stator and wherein, in at least one radial gap between the rotor and the stator, there is arranged a seal for reducing the radial gap, which seal has two opposite coatings, a first coating on a stator section delimiting the at least one radial gap radially to an outside and a second coating on a rotor section delimiting the at least one radial gap radially to an inside, the first and second coatings being built up from a ceramic powder having a particle size smaller than 1.0 μm.

2. The turbomachine of claim 1, wherein the first and second coatings have different hardnesses.

3. The turbomachine of claim 2, wherein the second coating is harder than the first coating.

4. The turbomachine of claim 1, wherein the first and second coatings have different thicknesses.

5. The turbomachine of claim 2, wherein the first and second coatings have different thicknesses.

6. The turbomachine of claim 4, wherein the second coating is thicker than the first coating.

7. The turbomachine of claim 3, wherein the second coating is thicker than the first coating.

8. The turbomachine of claim 1, wherein the first and second coatings are built up from individual layers.

9. The turbomachine of claim 1, wherein at least the rotor section comprises a multiplicity of elevations pointing in a direction of the stator section.

10. The turbomachine of claim 1, wherein the turbomachine is a gas turbine.

11. A turbomachine, wherein the turbomachine comprises a rotor and a stator and wherein, in at least one radial gap between the rotor and the stator, there is arranged a seal for reducing the radial gap, which seal has two opposite coatings, a first coating is on a stator section delimiting the at least one radial gap radially to an outside and a second coating on a rotor section delimiting the at least one radial gap radially to an inside, the first and second coatings being built up from powder-based individual layers, an outer layer of which having a higher ceramic fraction than a base layer close to the rotor section or stator section respectively, and a particle size of powder material being smaller than 1.0 μm.

12. The turbomachine of claim 11, wherein the first and second coatings have different hardnesses.

13. The turbomachine of claim 12, wherein the second coating is harder than the first coating.

14. The turbomachine of claim 11, wherein the first and second coatings have different thicknesses.

15. The turbomachine of claim 14, wherein the second coating is thicker than the first coating.

16. The turbomachine of claim 11, wherein at least the rotor section comprises a multiplicity of elevations pointing in a direction of the stator section.

17. The turbomachine of claim 1, wherein the particle size of powder material is at most 100 nm.

18. The turbomachine of claim 1, wherein an overall layer thickness of each of the first and second coatings is at most 0.1 mm.

19. The turbomachine of claim 11, wherein the particle size of powder material is at most 100 nm.

20. The turbomachine of claim 11, wherein an overall layer thickness of each of the first and second coatings is at most 0.1 mm.

* * * * *